US011024271B2

(12) United States Patent
Hopfinger

(10) Patent No.: US 11,024,271 B2
(45) Date of Patent: Jun. 1, 2021

(54) MUSICAL INSTRUMENT UTILITY HARNESS

(71) Applicant: Jack Jay Hopfinger, Grants Pass, OR (US)

(72) Inventor: Jack Jay Hopfinger, Grants Pass, OR (US)

( * ) Notice: Subject to any disclaimer, the term of this patent is extended or adjusted under 35 U.S.C. 154(b) by 0 days.

(21) Appl. No.: 16/853,703

(22) Filed: Apr. 20, 2020

(65) Prior Publication Data

US 2020/0388256 A1 Dec. 10, 2020

Related U.S. Application Data

(60) Provisional application No. 62/920,298, filed on Apr. 25, 2019.

(51) Int. Cl.
*G10G 5/00* (2006.01)

(52) U.S. Cl.
CPC ..... *G10G 5/005* (2013.01)

(58) Field of Classification Search
CPC ..... G10G 5/005
USPC ..... 84/327
See application file for complete search history.

(56) References Cited

U.S. PATENT DOCUMENTS 9,460,693 B2 * 10/2016 Mynatt ..... G10G 5/005
9,502,015 B1 * 11/2016 Coglitore ..... G10G 5/005

* cited by examiner

*Primary Examiner* — Jianchun Qin

(57) ABSTRACT

A musical instrument utility harness includes a utility harness for bearing the weight of a standard shoulder strap worn musical instrument on the core of the body while providing a means for accessing and fastening related accessories and adaptations, while providing a lateral stability strap assembly for dynamic lateral support and stability, while allowing complete hands free operation of the supported instrument. A holding strap inversion assembly for allowing the unhampered operation of control potentiometers and the like on electric instruments.

9 Claims, 11 Drawing Sheets

MUSICAL INSTRUMENT UTILITY HARNESS

CROSS REFERENCE TO RELATED APPLICATIONS

This application claims the benefit of U.S. Provisional Application No. 62/920,298 filed on Apr. 25, 2019. The above identified patent application is herein incorporated by reference in its entirety to provide continuity of disclosure.

BACKGROUND OF THE INVENTION

This invention relates to ergonomic musical instrument holding devices; more specifically, a Musical Instrument Utility Harness for complete shoulder relief.

Using a traditional shoulder strap to support an instrument such as a guitar can cause fatigue on the player's shoulders, neck and upper back. This has inspired, in the prior art an ergonomic device for cushioning the load of the instrument it bears, as well as offered more than one strap to provide a wider dispersion of the instrument's weight on the neck back and shoulders. While this offers some relief to the player's shoulder fatigue, it suggests an improvement needed for transferring the instrument's weight to the hips and core of an individual with a more severe back condition.

This need has inspired shoulder-less embodiments in the prior art. One such device offers a strap to be worn around the waist or midsection with additional straps to anchor the instrument to the waist. This particular design in the prior art requires a modification of the instrument in which an additional anchor point on the instrument's lower horn must be made for the device to function properly. This may not be desirable or suitable to the player who wishes to protect the integrity of their instrument's sentimental and monetary worth.

An embodiment in the prior art that does offer a solution to this obstacle of having to modify an instrument for a shoulder-less application, is a physical apparatus to be fastened to the user's body with stationary and moveable, loops and supplemental straps. While this apparatus based device offers safety and support to the instrument, it still suggests a need for a more aesthetically pleasing, and discrete device that, perhaps most importantly does not add weight and bulk to the equation of ergonomic relief. It also suggests the need for a device that is simple in design, easy to fasten and unfasten, and easy to store in small spaces such as a guitar bag or case.

Another necessity to consider when improving on shoulder-less embodiments in the prior art, is a means to support instruments dramatically ranging in sizes.

These considerations of needed improvement in the prior art are what inspire the present inventor to suggest an ergonomic device for completely supporting musical instruments and their related accessories on the body's core in place of the shoulders, with the versatility of being worn between the torso and waist of individuals of all body sizes, while implementing and revising the function of a standard shoulder strap to one that provides fully adjustable, lateral stability to the supported instrument. Therefore, what is clearly needed is a Musical Instrument Utility Harness to solve the problems mentioned above.

BRIEF SUMMARY OF THE INVENTION

In one embodiment of the invention a musical instrument utility harness is provided, comprising a utility harness for bearing the weight of a standard shoulder strap worn musical instrument on the body, a means for accessing and fastening related accessories and adaptations to the embodiment, and a lateral stability strap assembly for dynamic, lateral support and stability with allowance for a complete hands-free operation of the supported instrument. An embodiment also provides a holding strap inversion assembly for allowing the unhampered operation of control potentiometers and the like on electric instruments.

Also in one embodiment a musical instrument utility harness assembly can be fastened in reverse to accommodate opposite handed applications.

Also in one embodiment a utility harness is provided and comprises a harness made of an elongated band of resilient, and pliable material with a composition comparable to closed cell foam, wherein having two ends approximately 3½ inches in width, two ends 45 inches in length, and a ½ inch in thickness.

Also in one embodiment a harness is completely encased with a material comprising a thin sheet of resilient and pliable material such as cordera fabric with two lengths and two widths.

Also one embodiment provides a holding strap assembly comprising a holding strap of nylon webbing like composition, with approximate dimensions of 70 inches in length, 2 inches in width, and lined with similar sized velcro material for areas that require fastening and gripping.

Also in one embodiment the utility harness comprises a two piece side squeeze buckle for fastening the harness to the body from the torso to waist, thereby allowing natural core support and a provision for a "belt and buckle-connected" anchor to encircle the portion of instrument to be held with the holding strap, and fasten to a desired, velcro lined corresponding area on the holding strap.

Also in one embodiment, a utility harness provides a means for fastening and accessing accessories, wherein one or more velcro based pockets and attachable arms for holding, and holstering instrument related accessories, such as picks, wireless transmitter, slide and the like are included.

Also in an embodiment a utility harness provides a means of attaching adaptations with velcro material, wherein a holding strap extension for adapting to instruments with larger bodies is attached to the applied velcro on the end of the holding strap portion of the holding strap assembly.

Also in one embodiment a lateral stability strap assembly is provided, and comprises a lateral stability strap, and a lateral stability strap sleeve.

Also in one embodiment, the lateral stability strap can comprise a resilient and pliable material with two equal elongated lengths, two equal widths, reinforced stitched holes for anchoring to instrument's strap pins, and stitched-on portions of velcro for added grip on the utility harness.

Also in one embodiment a lateral stability strap may include two adjusting buckles, each positioned on a stitched loop of both ends of the said strap for fine tuning the strap arm lengths to achieve any desired instrument lateral position.

Also in one embodiment the lateral stability strap sleeve conforms to a shape similar to an isosceles trapezoid wherein, (a) both sides of the sleeve have congruent interior angles to their respective parallel ends of two different lengths, (b) the shorter said end adheres with velcro to the holding strap assembly, adjacent to user's spine, (c) the longer end encircles the entire harness and fastens with interior stitched velcro to the shorter end thereby securing the lateral stability strap.

In one embodiment a holding strap inversion assembly is provided, and comprises a metallic u-shaped auxiliary clip, with 90 degree interior angles for standing the holding strap in an inverted position between the controls of electric instruments while positioned perpendicularly to the surface of the instrument, a non-abrasive length of protective foam like material shaped and adhered to underside of the auxiliary clip for protecting the surface of the supported instrument, and a sleeve of spandex material or that of equivalent function and composition.

Also in one embodiment the holding strap inversion assembly's foam backed auxiliary clip and retaining sleeve secure the folded instrument strap in a perpendicular position on the surface of an electric instrument to prevent the instrument's controls from being inadvertently moved by the holding strap, while the auxiliary clip's underside protective backing helps to protect the finish of the instrument.

In another aspect of the embodiment a method for utilizing the Musical Instrument Utility Harness is provided, comprising the steps; (a) buckling the overlapping ends of the utility harness around the desired area on the body between the torso and waist, (b) pulling the holding strap positioned through, and anchored to the attached male buckle end for obtaining the desired tightness of the provided harness around the body, (c) securing a desired portion of the instrument to be supported by pulling the provided, secured holding strap around the instrument and fastening its securing strap to a desired velcro area on the holding strap assembly, (d) temporarily removing the secured instrument from the formed looped made by the secured holding strap, (e) rotating the fastened utility harness 180 degrees to attach the lateral stability strap assembly, (f) perpendicularly inserting one end of the lateral stability strap through an unfastened portion of velcro material on the holding strap assembly, in an area adjacent to the body's spine, and looping the said strap end around the original inserted area, (g) adjusting the lateral stability strap's looped position with respect to the length desired of the strap arms, (h) fastening the lateral stability strap sleeve to the adjusted, positioned, looped lateral stability strap, (i) rotating the utility harness 180 degrees to its original position, (j) reinserting the instrument to its secured preformed holding strap loop, (k) attaching the strap arm ends to their designated strap pins mounted to the supported instrument, (l) fine tuning the length of the stability strap arms with the provided adjusting buckles to achieve to achieve the instrument's desired stabilized lateral position, and (m) attaching desired accessories to utility harness as needed.

In the described figures; velcro material is symbolized by a row of Xs, reinforced stitching is symbolized with a single row of broken dashes, double reinforced stitching is displayed as a double row of broken dashes. Congruent angles are symbolized with double and single arcs on the corners of an isosceles trapezoid shaped lateral stability strap sleeve in FIG. 5B. The word, "arm" is used to reference one half of the length of the straps described in the present embodiment's lateral stability strap assembly. The inventor of the present embodiment suggests that these should only be recognized as symbols and method of assembly, and do not represent the appearance of the disclosed embodiment.

DETAILED DESCRIPTION OF THE INVENTION

The inventor provides a musical instrument utility harness designed to completely support the weight of standard shoulder strap worn stringed instrument on the body's hips and core area, thereby relieving the weight potentially endured on the shoulders with a standard shoulder strap. The embodiment further suggests an assembly for providing dynamic lateral stability to the supported instrument. The disclosed embodiment is also designed to adapt to electric guitars and the like by providing an instrument holding strap inversion assembly for preventing inadvertent movement of electronic controls on the face of an instrument as well as protect the finish on the supported instrument. The present invention is described in enabling detail in the following examples, which may represent more than one embodiment of the present invention.

Figure 1A:
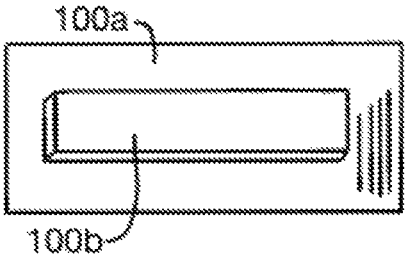
FIG. 1A is a top view of one embodiment's harness and harness encasement.

FIG. 1A is a top view of one embodiment's harness and harness encasement. In an embodiment of the present art, a harness 100*a* can be made of closed cell foam and its outer encasement 100*b* can be made of cordera fabric.

Figure 1B:
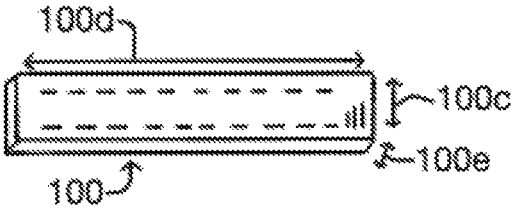
FIG. 1B illustrates an embodiment's harness and encasement combined.

FIG. 1B illustrates an embodiment's harness and encasement combined. In one embodiment, 100*a* and 100*b* are combined with reinforced stitching to form an encased harness 100 for the utility harness assembly illustrated in FIG. 1C. Because 100 has equal widths, as well as equal lengths, one reference for each pair is provided to describe both respective ends and sides. In one embodiment in the present art, the encased harness ends 100*c* are 3½ inches in width, sides 100*d* are 45 inches in length, and overall thickness 100*e* is a ½ inch.

Figure 1C:
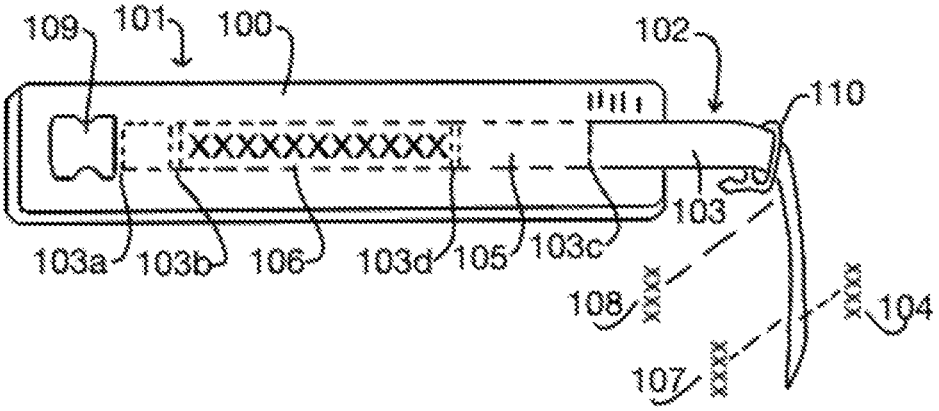
FIG. 1C is a top view of the embodiment's utility harness assembly with its suggested components proportionally placed.

FIG. 1C is a top view of the embodiment's utility harness assembly with its suggested components proportionally placed. Part of this assembly 101 includes a holding strap assembly 102, which is made on a 70"×2" strap of nylon webbing 103. The holding strap 103 is lined with portions of velcro material used for fastening components to desired corresponding velcro stitched areas on the holding strap assembly 102. The velcro lined area at the end of the holding strap 104 secures an instrument positioned at a non abrasive area 105, and fastens at a desired corresponding velcro area 106 on 101. In one embodiment of the present art, velcro area 106 is also used as a mounting location for a velcro backed accessory pocket as well as a fastening point for a lateral stability strap which both will be described in the following figure descriptions. In one embodiment of the present art, velcro area 107 is on the opposite face of the holding strap velcro end 104, and is used to fasten a velcro based extension holding strap, referenced in FIG. 3. This allows for attaching instruments with larger bodies to this embodiment. Velcro area 108 can be used for a velcro based arm for attaching accessories that require fast and easy access, such as a guitar slide. The slide and attaching arm are both shown in FIG. 3. Once the designated velcro areas have been secured to the holding strap assembly, an end of the holding strap 103*a* can be attached with a stitched loop to the female end 109 of a two-piece side squeeze buckle. The appropriate stitch is referenced with a single row of dashes adjacent to the female buckle end at 103*a*. The holding strap to harness stitch begins at the double reinforced stitch marked with a double row of dashes at area 103*b*. In this embodiment of the present art, 103*b* is approximately 6" inches in from its respective harness end. Single reinforced stitching from the 103*b* double stitch point continues to fasten the holding strap to single reinforced stitch mark 103*c*, approximately 4" from its respective end of the harness, and continues to follow the single stitch path back to the starting point at 103*b*, creating a path resembling an elongated rectangle. An additional double reinforced stitch is made across the width of the holding strap at area 103*d* to provide a strong foundation for the velcro material of area 106. The male buckle end 110 is slid onto the holding strap and is positioned at the fold of the holding strap as indicated in its position in FIG. 1C.

Figure 2:
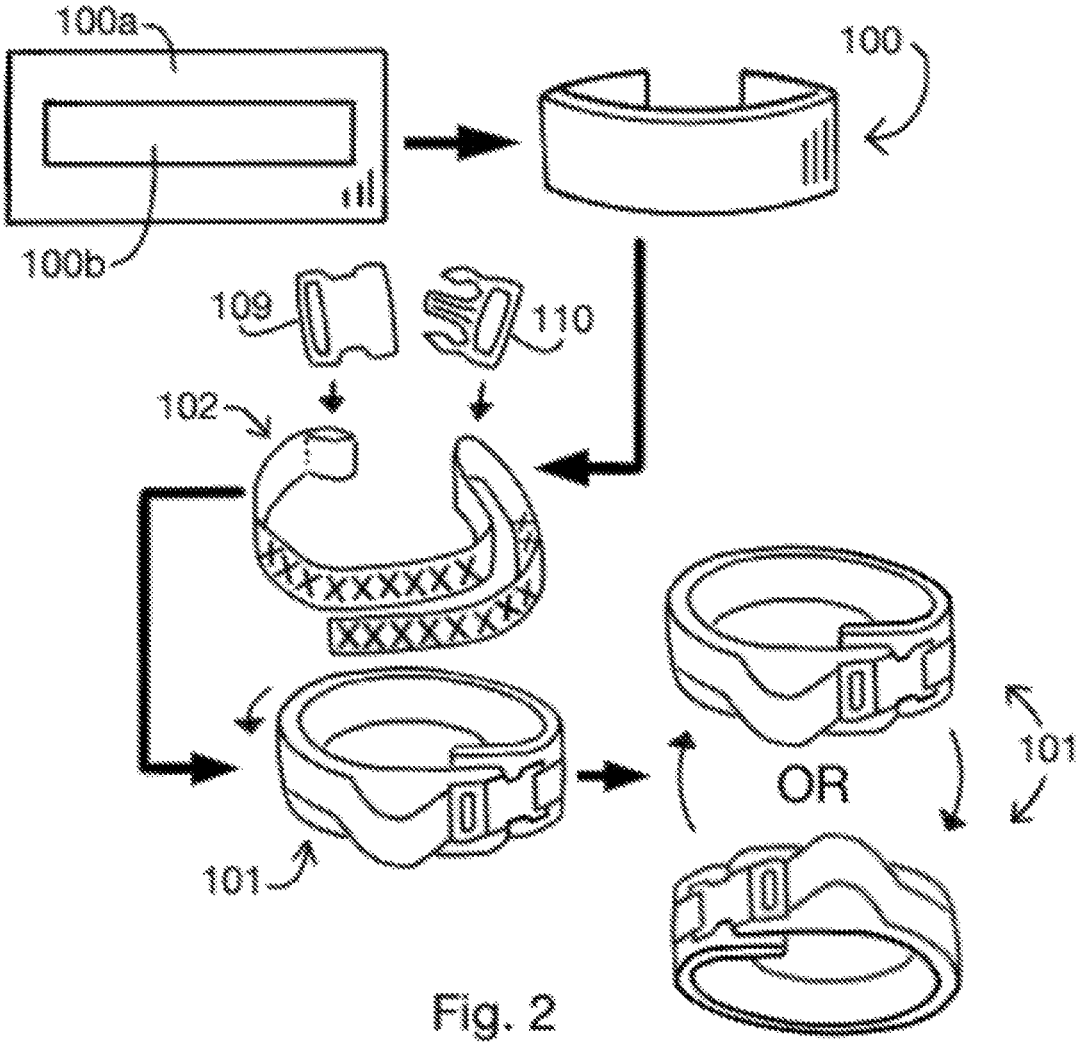
FIG. 2 is a flow diagram of the suggested steps in building the utility harness assembly shown in FIGS. 1A, B, and C, and manner in which an embodiment is inverted 180 degrees for opposite hand applications.

FIG. 2 is a flow diagram of the suggested steps in building the utility harness assembly shown in FIGS. 1A, B, and C, and manner in which an embodiment is inverted 180 degrees for opposite hand applications. The inventor of the present embodiment intends FIG. 2 to add a dimensional perspective of the embodiment described in FIGS. 1A, B, and C. In one embodiment of the present art the sheet of cordera 100*a* covers and is secured with reinforced stitching to the closed cell foam harness material 100*b*, as shown in FIG. 1B and forms the embodiment's encased harness 100. One end of the holding strap assembly 102 attaches the female end of buckle 109 with a stitched loop. The male end of buckle 110 slides onto the opposite end of holding strap assembly and is positioned at the fold on the holding strap as illustrated in the diagram under male buckle 110. The holding strap assembly is stitched to the harness as described in FIG. 1 and the utility harness assembly 101 is now complete and ready for adaptive, velcro lined attachments. For opposite-hand applications, 101 can be inverted 180 degrees as displayed at the end of the flow diagram in FIG. 2. While all of the elements and functions of the disclosed embodiment in the present art can be applied to either a right handed or left handed person, it should be understood that the disclosed embodiment describes the right handed application.

Figure 3:
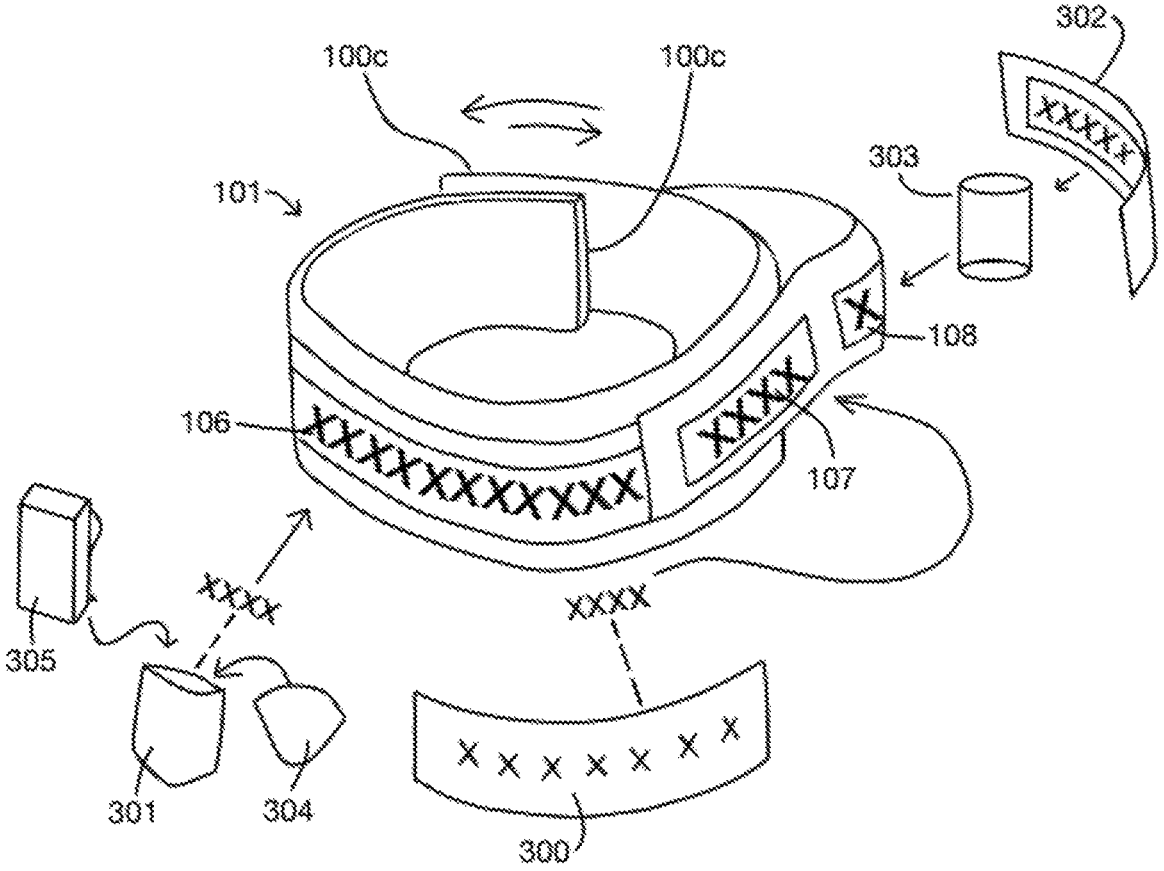
FIG. 3 is a rear perspective view of the utility harness assembly of FIG. 1 and its utilization of velcro attaching, adaptive capabilities in one embodiment of the present art.
Figure 4:
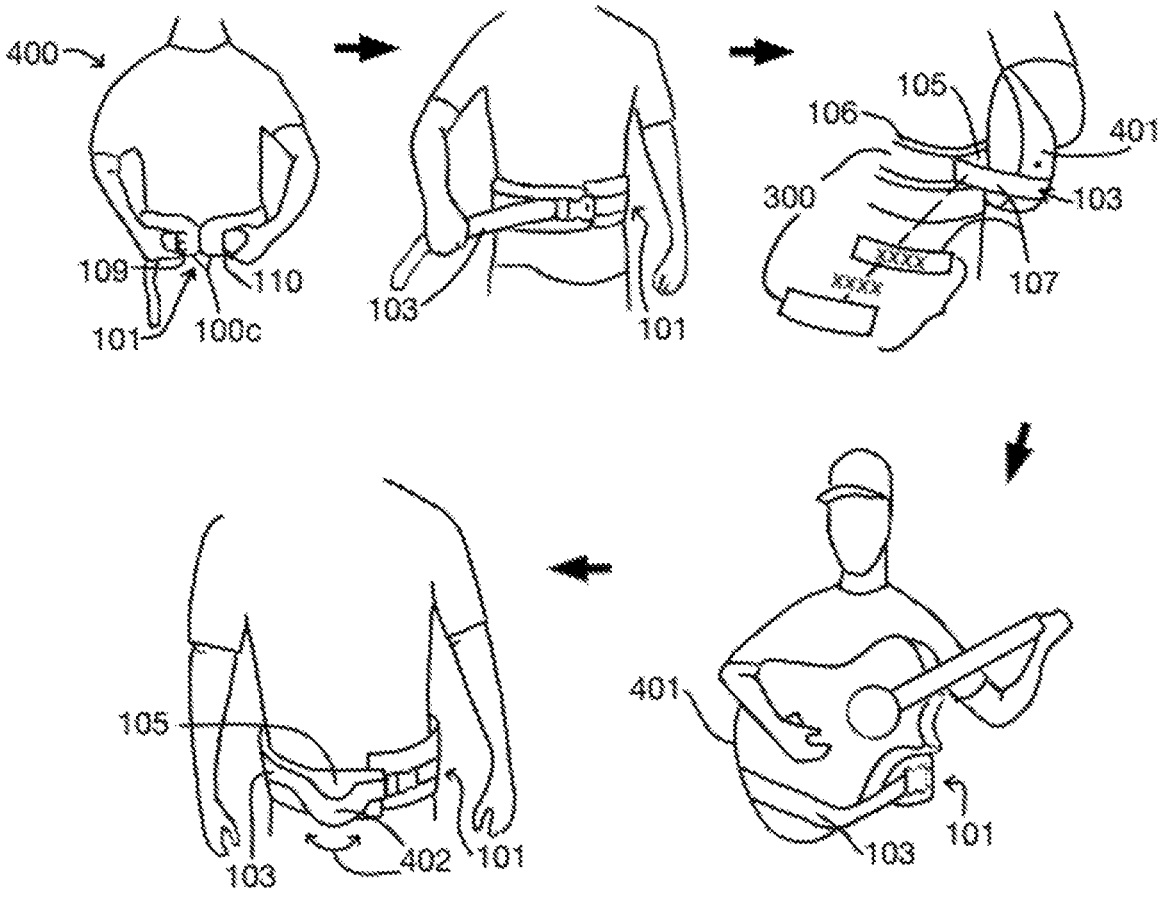
FIG. 4 is a flow diagram of a person fastening an instrument with a larger body to the utility harness assembly with the use of the velcro based extension holding strap described in FIG. 3.

FIG. 3 is a rear aerial perspective of the utility harness assembly 101 and its utilization of velcro attaching, adaptive capabilities in one potential embodiment of the present art. The ends of the harness assembly 100*c* can fasten to different body sizes in an overlapped position. A velcro based extension strap of pliable and resilient material 300 can fasten to the velcro end of the holding strap 107 to accommodate instruments with larger bodies as shown in FIG. 4. The disclosed embodiment also suggests the application of velcro material for the function of one or more pockets 301 of resilient, pliable material attaching to any desired 106 velcro area for holding and holstering various accessories such as picks 304, and wireless transmitters 305. One embodiment can also provide one or more velcro based fastening arms 302 made with materials similar to 300 and 301 to allow the player easy access to other instrument related accessories such as a guitar slide 303. FIG. 3 shows the attaching arm 302 securing a slide 303 to velcro area 108.

FIG. 4 is a flow diagram of a person fastening an instrument with a larger body to the utility harness assembly with the use of the velcro based extension holding strap described in FIG. 3. In the first step, the utility harness assembly 101 is wrapped around the desired area of the users body 400, overlapping at the ends 100*c*, then fastened by connecting both buckle ends 109, 110 in front of the body. In the second step, the holding strap 103 is pulled to tighten the utility harness assembly 101. In the third step, the holding strap 103 is wrapped around the body of the instrument to be held 401 after 401 is placed at the designated non velcro area on the utility harness assembly 105. In this step, the velcro based extension holding strap 300 is fastened to its corresponding velcro area on the end of the holding strap 107 to adequately reach around the body of the guitar 401 and fasten to a corresponding velcro attaching area on the utility harness assembly 106. The fourth step shows how the instrument 401 is fitted to its supporting area on the utility harness 101 with its now extended holding strap103. The final step shows how the instrument can be removed while retaining the preformed loop 402 created from the original attachment of the instrument to the utility harness assembly 101. This preformed loop 402 of 103, around area 105 allows the instrument to be removed and reinserted as desired without the need of unfastening 103 from its velcro area on the utility harness assembly. This loop 402 will also be referenced in FIG. 7*a*.

Figure 5A:
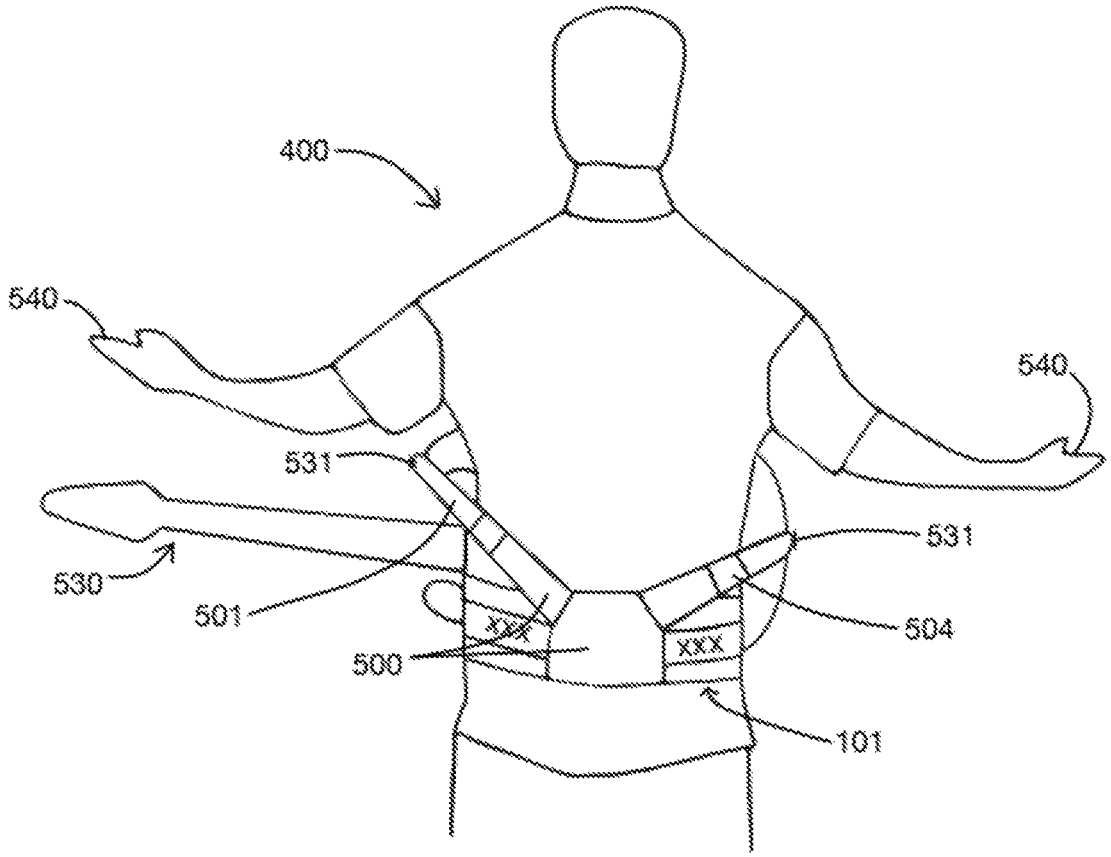
FIG. 5A is a rear perspective view of a person utilizing an embodiment's lateral stability strap assembly while displaying the assembly's hands-free attribute.

FIG. 5A is a rear perspective view of a person utilizing an embodiment's lateral stability strap assembly while displaying the assembly's hands-free attribute. An embodiment's lateral stability strap assembly 500 is fastened to the back of the utility harness assembly 101 to provide a person 400 with adjustable, dynamic, and lateral support and stability of an instrument, such as an electric guitar 530. 500 allows the complete, hands-free 540 operation of the supported instrument 530. FIG. 5A also shows how the buckle 504 adjusting lateral stability strap 501 component of the assembly 500 anchors to the instrument's 530 strap pins 531.

Figure 5B:
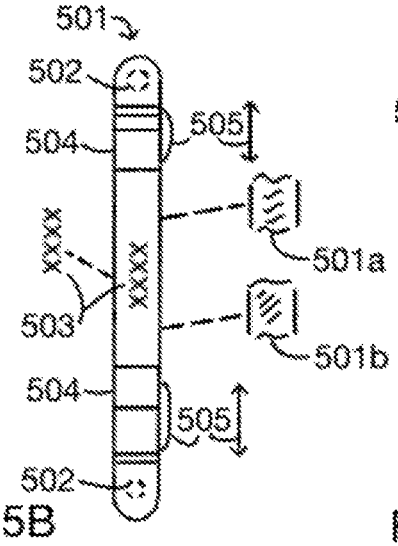
FIG. 5B is an elevation view of an embodiment's optional lateral stability strap.
Figure 5C:
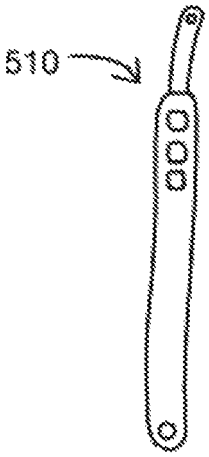
FIG. 5C is an elevation view of a standard shoulder strap from the prior art.
Figure 5D:
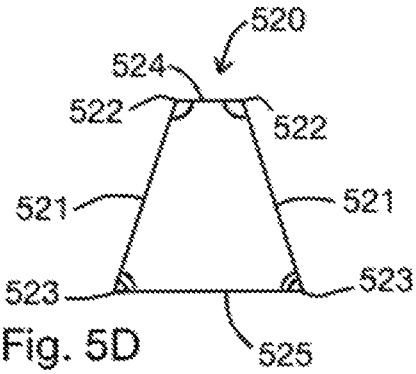
FIG. 5D displays an elevation view of an embodiment's lateral stability strap sleeve.
Figure 5E:
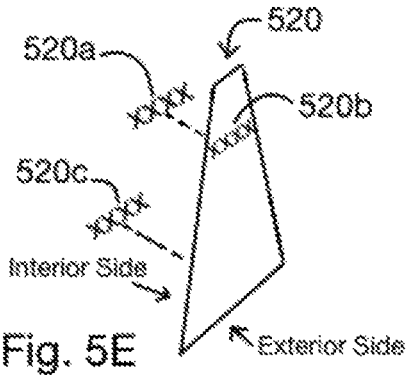
FIG. 5E displays a perspective view of an embodiment's lateral stability strap sleeve.
Figure 5F:
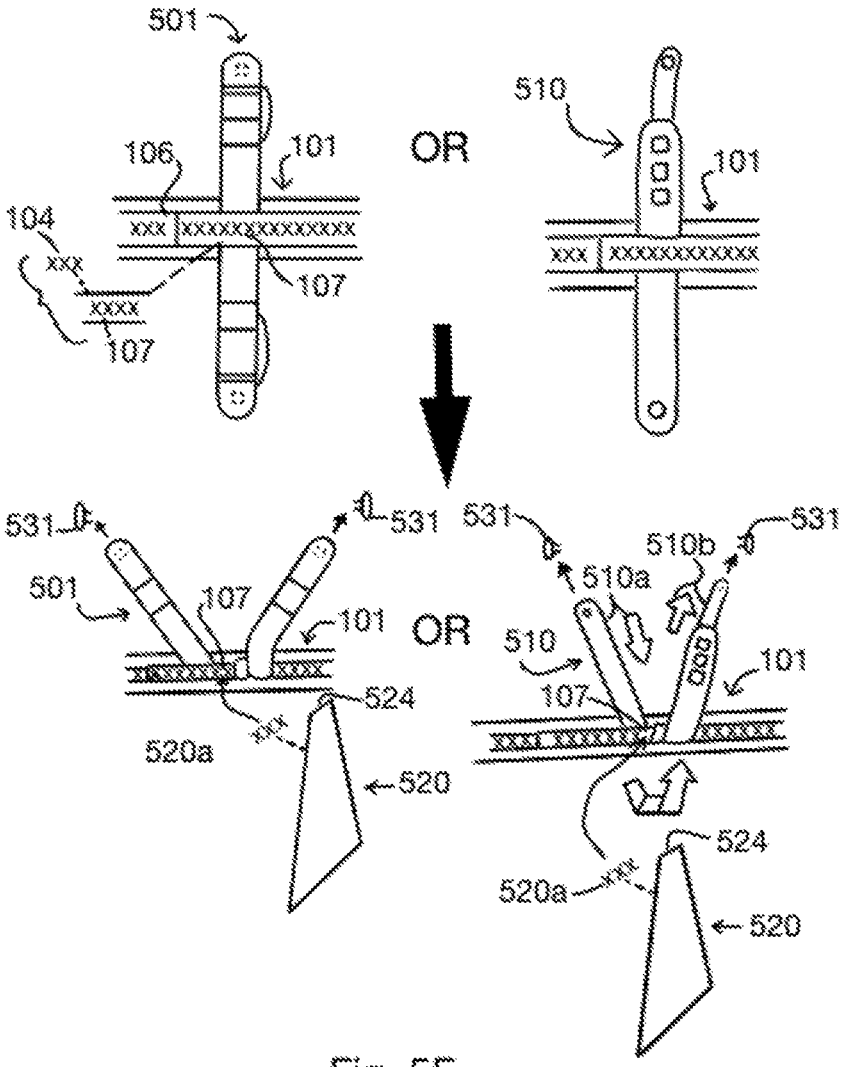
FIG. 5F illustrates the first two steps a flow diagram of the suggested steps in applying the lateral stability strap assembly to the utility harness assembly in an embodiment of the present art.

FIG. 5B is an elevation view of an embodiment's optional lateral stability strap. 501 comprises an elongated length of pliable and resilient material, such as leather 501*a* or nylon 501*b* in other embodiments in the present art. 501 also has two reinforced stitched holes 502 for anchoring to instrument's strap pins 531 illustrated in FIG. 5A. 501 also includes one or more stitched-on portions of velcro 503 for adding strength to it's grip on the utility harness's holding strap assembly, shown in the first step in FIG. 5F. Two adjusting buckles 504 are positioned on a stitched loop 505 of both arms of 501. The arrows adjacent to the 505 references indicate the lengthening and shortening adjustment capability of each end of 501. This allows the instrument 530 to be positioned at any desired dynamic lateral angle while supported by the present embodiment's utility harness assembly as illustrated in FIG. 5A.

FIG. 5C is an elevation view of a standard shoulder strap from an embodiment of the prior art. The standard shoulder strap 510 can be used as a substitute for 501 described in FIG. 5B. The allowance of this embodiment's incorporation of 510 suggests a revised function of a standard shoulder strap to a strap that assists in providing lateral stability for an embodiment in the present art.

FIG. 5D displays an elevation view of an embodiment's lateral stability strap sleeve. 520 is used for securing 501 or 510 in a velcro gripped, looped position at area 106 on the holding strap assembly as shown in the first step of FIG. 5F. FIG. 5D also illustrates the lateral stability strap's 520 resemblance to the shape of an isosceles trapezoid in that both legs 521 have congruent interior angles 522 and 523 to parallel bases of two lengths. 524 is the top, shorter base and 525 is the bottom, longer base.

FIG. 5E displays a perspective view of an embodiment's lateral stability strap sleeve. The perspective view of 520 is provided in FIG. 5E to show where portions of velcro are located on 520 for securing 520 to either 501 or 510 to the back of the utility harness as shown in the second step in FIG. 5F. The interior and exterior sides illustrated in FIG. 5E are referenced with arrows, wherein the former refers to the side facing the user's body and the latter represents the side away from the body. A portion of velcro 520*a* is on the top, interior side. A portion of velcro 520*b* is on the top exterior side. A portion of velcro 520*c* is on the lower interior side.

FIG. 5F illustrates the first two steps a flow diagram of the suggested steps in applying the lateral stability strap assembly to the utility harness assembly in an embodiment of the present art. While the implementation of the optional lateral stability strap 501 will be used in the steps of FIG. 5F, an additional description of how 510 can similarly be implemented in both steps will be provided as well. In the first step, the lateral stability strap 501 or a traditional shoulder strap 510 is straightly inserted through an un-gripped portion of velcro between area 106 on the utility harness assembly 101, and velcro area 104 on the end of the holding strap on the interior side, opposite from the extension strap velcro area 107. Step 2 in FIG. 5F shows how the arms of either 501 or 510 after inserted through the un-gripped opening on the holding strap assembly are looped around the holding strap and positioned in an outward symmetrical direction toward their corresponding anchoring instrument strap pins 531. Arrows illustrating the strap ends directed toward 531 are provided for 501 and 510. Implementing the user's standard shoulder strap 510 in this step can be achieved by creating a desired amount of loops around the same area as illustrated with 501 to achieve the desired arm length between the anchored position on the utility harness to the respective strap pins 531 of the supported instrument. In the application of a standard shoulder strap, the arrow below 510 attaching to 101 illustrates this looping adjustment. The standard shoulder strap 510 in its loose, looped position can also be pulled by one end 510*b* to add length while simultaneously shortening the other end 510*a* as illustrated by the arrows corresponding to their references in the application of 510. Once either 501 or 510 are in their desired positions, the lateral stability strap sleeve 520 can be adhered to velcro area 107. Step 2 in FIG. 5F shows velcro area 520*a* fastening the top, shorter 524 interior side of 520 to velcro area 107 at the end of the holding strap in both applications.

Figure 5G:
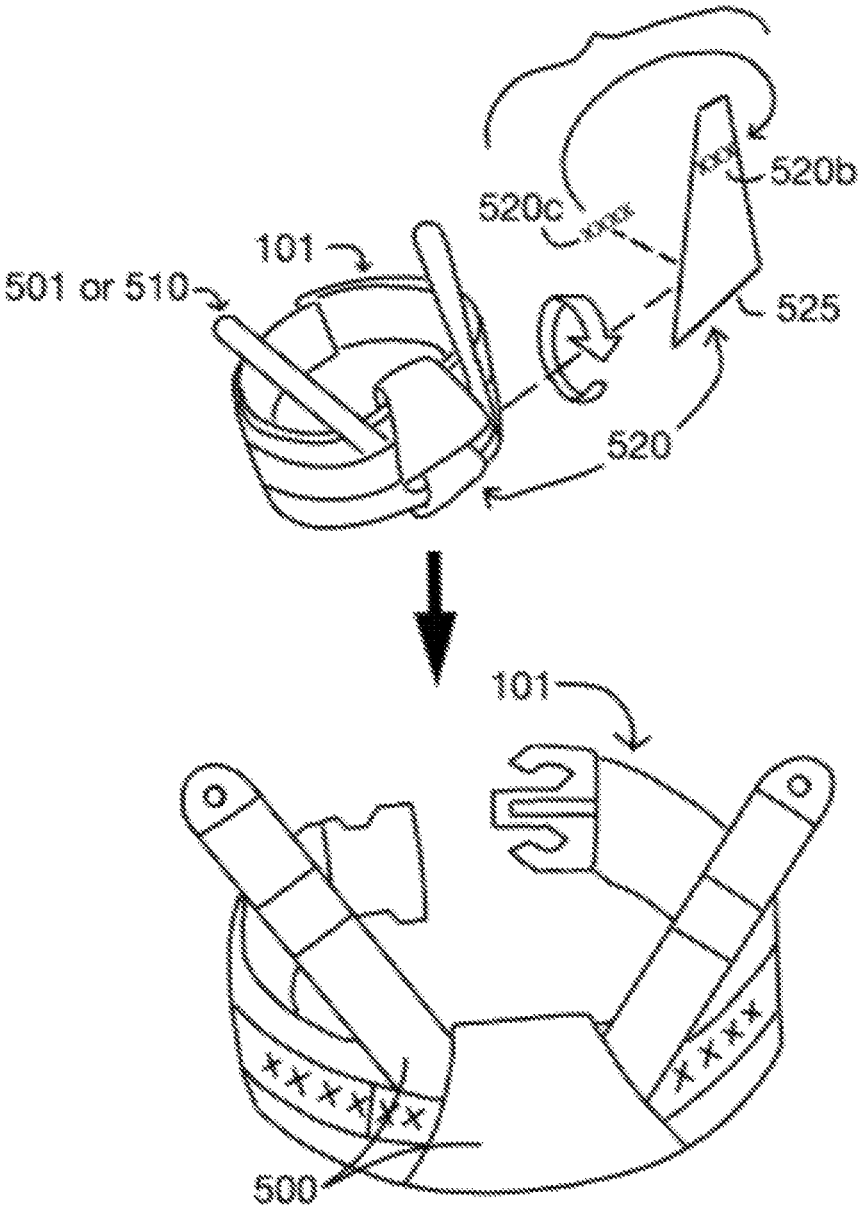
FIG. 5G includes the final two steps of the flow diagram of FIG. 5F.

FIG. 5G includes the final two steps of the flow diagram of FIG. 5F. Step 3 displays a perspective image with an exploded view of how the longer base 525 of the lateral stability strap sleeve 520 encircles the entire harness 101 in either application of 501 or 510, and fastens with interior stitched velcro 520*c* to velcro area 520*b* on the exterior side of 520, thereby securing the lateral stability strap 501 or the user's shoulder strap 510 to the utility harness assembly 101. An arrow around the projection line helps describe this attachment. The fourth, and final step is a perspective view of the lateral stability strap assembly 500 fastened to the back of 101. A further description of fine tuning the arm length of 501 will be provided in FIG. 7B.

Figure 6:
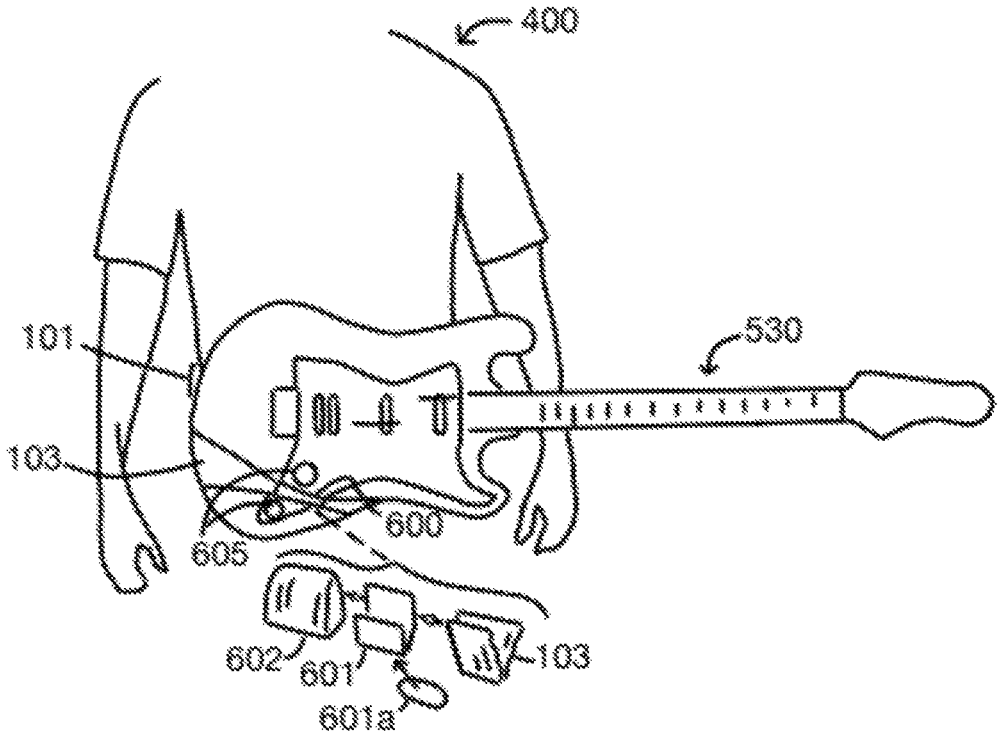
FIG. 6 is an arial perspective view of one embodiment's holding strap inversion assembly utilized on an electric guitar.

FIG. 6 is an arial perspective view of one embodiment's holding strap inversion assembly utilized on an electric guitar. It includes a person 400 supporting their electric guitar 530 with the utility harness assembly 101 with the embodiment's implemented holding strap inversion assembly 600. FIG. 6 also includes an exploded view illustrating how a portion of the holding strap 103 can be folded, inserted as illustrated by the arrow, and held by the inversion assembly's metallic, u-shaped auxiliary clip 601. The auxiliary clip 601 secures the folded strap in a perpendicular position on the surface of the instrument 530 between the volume and tone controls 605 with an embodiment's auxiliary clip retaining sleeve 602 which is indicated by an arrow between 602 and 601 in the exploded view. In one embodiment of the present art, 602 can be made of spandex or material equivalent in function and composition. The function of the holding strap inversion assembly is to prevent the instrument's controls 605 from being inadvertently moved by the holding strap 103 while a protective foam backing 601*a* is adhered to the underside of 601 to protect the instrument's finish.

Figure 7A:
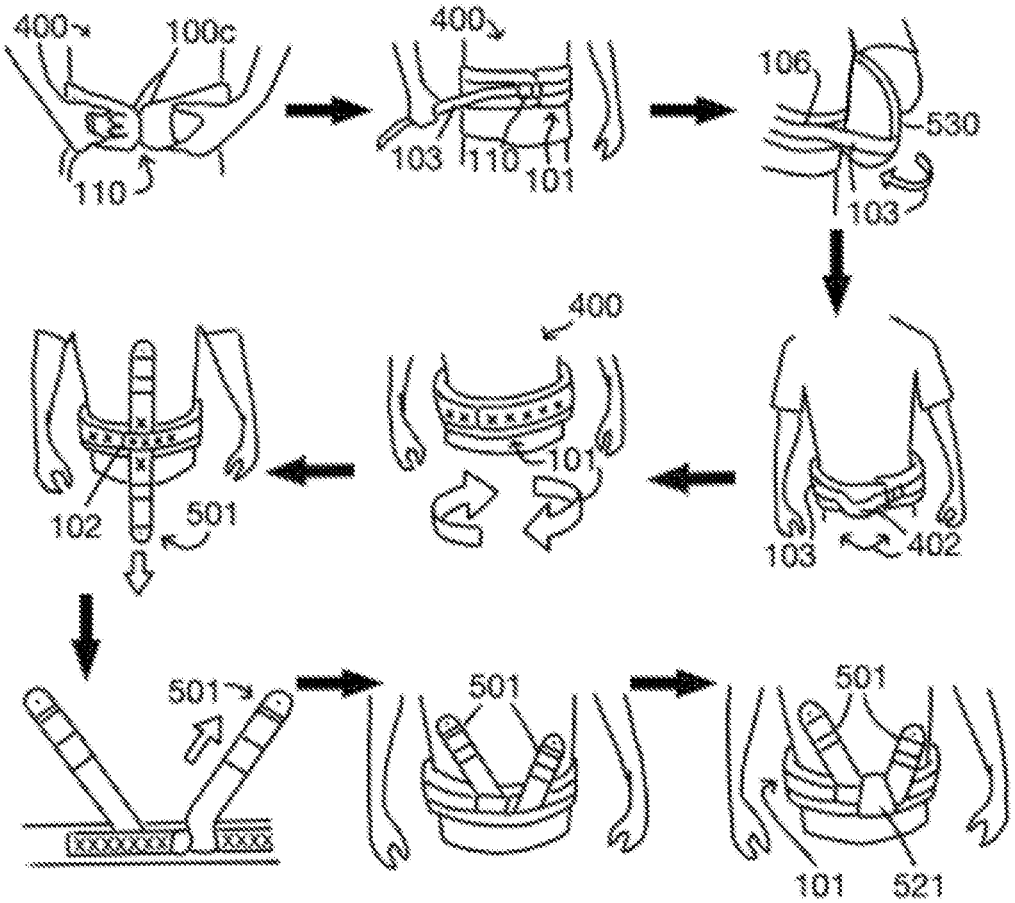
FIG. 7A is a flow diagram describing the method for utilizing the Musical Instrument Utility Harness in an embodiment of the present art.

FIG. 7A contains the first 9 steps of flow diagram describing the method for utilizing the Musical Instrument Utility Harness in an embodiment of the present art. The following steps include: Step 1, buckling the overlapping ends 100*c* of the utility harness 101 around a desired area on the body 400 between the torso and waist. Step 2, pulling the holding strap 103 positioned through and anchored to the attached male buckle end 110 for obtaining desired tightness of the utility harness 101 around the body 400. Step 3, securing a desired portion of the instrument to be supported 530 by pulling the secured holding strap 103 around the instrument 530, and fastening to velcro area 106 on holding strap assembly. Step 4, temporarily removing secured instrument from, formed looped 402 made by secured holding strap 103. Step 5, rotating fastened utility harness 101 around the body 400, 180 degrees to attach the lateral stability strap assembly. Step 6, inserting one end of lateral stability strap 501 through an unfastened portion of velcro material on the holding strap assembly 102 in a perpendicular fashion. Step 7, looping 501 bottom strap arm around the same area as inserted and positioning it upward in a direction symmetrical to its opposite arm end. Step 8, adjusting the lateral stability strap's 501 looped position with respect to desired length of strap arms. Step 9, fastening the lateral stability strap sleeve 521 around the lateral stability strap 501 and utility harness 101.

Figure 7B:
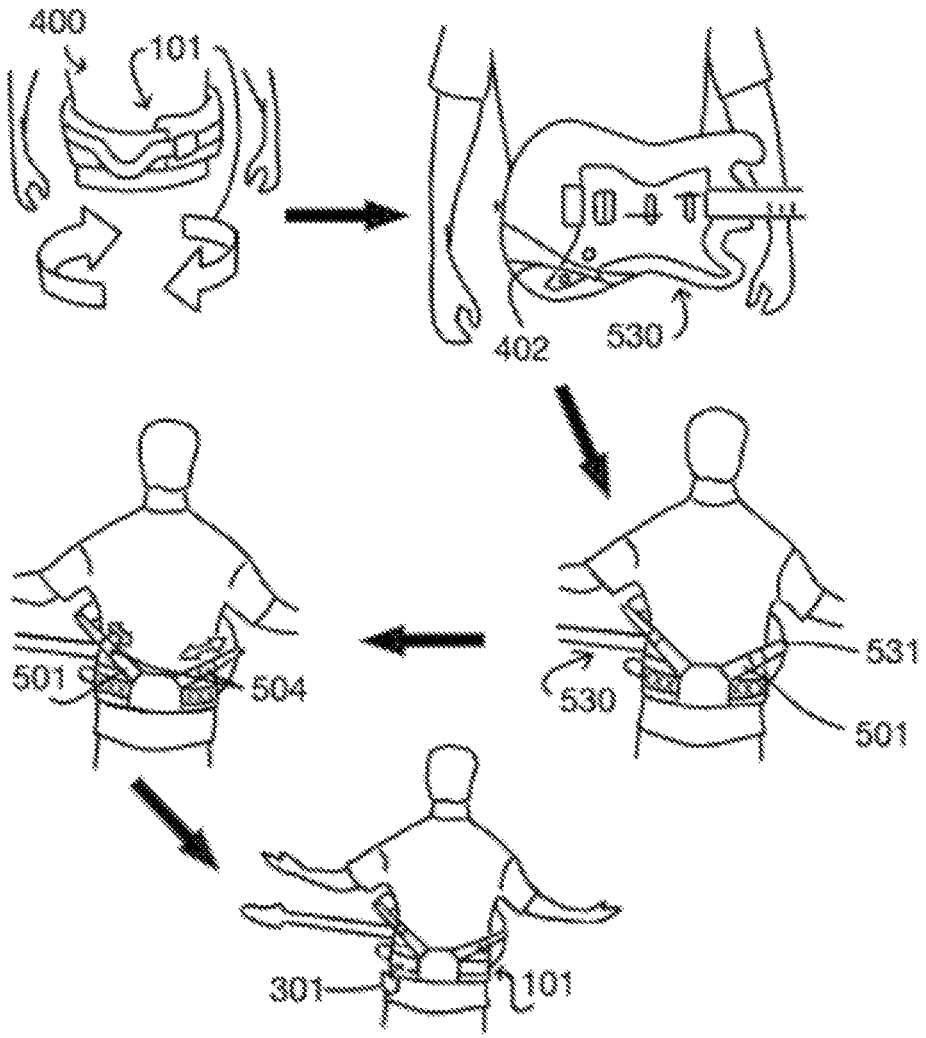
FIG. 7B contains the final 5 steps of the flow diagram in FIG. 7A.

FIG. 7B contains the final 5 steps of the flow diagram in FIG. 7A. Step 10, rotating the utility harness 101 around the body 400 to original position. Step 11, reinserting instrument 530 to secured preformed holding strap loop 402. Step 12, attaching strap arm ends of 501 to designated strap pins 531 on the supported instrument 530. Step 13, fine tuning length of said strap arms 501 with adjusting buckle 504 to achieve the instrument's 530 desired stabilized lateral position. Step 14, attaching desired accessories 301 to utility harness 101.

It will be apparent to one with skill in the art that the shoulder-less instrument utility harness of the invention may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

What is claimed:

1. A musical instrument utility harness comprising:

a utility harness assembly for supporting a standard shoulder strap worn musical instrument and instrument related accessories and adaptations on the user's body;

a lateral stability strap assembly for holding the instrument supported by said utility harness assembly in a stabilized position without requiring the use of user's hands, sug-gesting an improvement in the prior art, further comprising, a. an optional lateral stability strap of elongated, pliable and resilient material having two equal lengths and two equal widths with reinforced stitched holes for anchoring said lateral stability strap to instrument's strap pins, and including stitched-on portions of velcro for adding strength to said lateral stability strap's grip on a velcro lined holding strap of the utility harness assembly, b. an option to incorporate the user's personal shoulder strap with a revised function of providing lateral stability to the supported instrument, and c. a lateral stability strap sleeve for securing said optional lateral stability strap or user's personal shoulder strap in a looped position gripped by the velcro on said velcro lined holding strap, wherein said lateral stability strap sleeve forms an isosceles trapezoid with both legs having congruent interior angles to parallel bases of two lengths of which the shorter of said bases adheres with said velcro to designated area on said utility harness assembly adjacent to user's spine, while the longer base end encircles the entire harness assembly and fastens with interior stitched velcro to attached said shorter base of lateral stability strap sleeve thereby securing said lateral stability strap to the utility harness assembly; and a holding strap inversion assembly for adapting said holding strap of said utility harness assembly to support electric instruments on the user's body, wherein said holding strap inversion assembly secures said holding strap in a folded position between moveable controls on the surface of said electric instruments.

2. That utility harness assembly in claim 1, wherein is fastened to the user's body in reverse for accommodating opposite handed applications.

3. That utility harness assembly in claim 1, further comprising:

a harness having an elongated band of resilient, and pliable material with composition comparable to closed cell foam, and having two ends of approximate 3½ inches in width, two lengths of approximate 45", and approximately ½" thickness;

a casing for said harness, wherein a thin sheet of resilient and pliable material adequate in size for completely covering and securing to said harness;

a holding strap assembly of nylon webbing or equivalent in composition with approximate dimensions of 70" in length×2" in width and lined with velcro material equal in width for areas that only require fastening and gripping; and a two piece side squeeze buckle or one comparable in function for fastening harness to the body between waist and torso for natural core support and providing a secured belt and buckle-connected anchor for holding strap to encircle portion of instrument to be held and fastened to desired velcro lined corresponding area on holding strap velcro area.

4. That holding strap assembly lined with portions of velcro material in claim 3 for attaching and accessing instrument related accessories and adaptations supported by the utility harness assembly in claim 1, wherein one or more velcro based pockets and attachable arms for holding, and holstering instrument related accessories such as picks, wireless transmitter, slide and the like are included with said holding strap assembly.

5. That holding strap assembly lined with portions of velcro material in claim 3 for attaching and accessing instrument related accessories and adaptations supported by the utility harness assembly in claim 1, wherein a holding strap extension for adapting to instruments with larger bodies is attached to applied velcro on the end of the holding strap of said utility harness assembly.

6. That optional lateral stability strap in claim 1, wherein includes two adjusting buckles positioned on a stitched loop of both ends of said strap for adjusting the overall length of said strap to achieve desired lateral adjustment of the supported instrument.

7. That holding strap inversion assembly in claim 1, wherein comprises:

an auxiliary metallic u-shaped clip with 90 degree interior angles for standing the holding strap in an inverted position between controls of electric instruments while said clip is positioned perpendicularly to the surface of said instrument;

a non-abrasive length of protective foam like material shaped and adhered to underside of said auxiliary clip for protecting the surface of supported instrument; and an auxiliary clip retaining sleeve of spandex material or that of equivalent function and composition as a means of holding together the folded holding strap in the auxiliary clip while positioning said holding strap inversion assembly between the control potentiometers on the face of supported electric instruments.

8. That holding strap inversion assembly in claim 7, wherein said foam backed auxiliary clip and said retaining sleeve secure the folded instrument holding strap in a perpendicular position on the surface of an electric instrument to prevent said instrument's controls from being inadvertently moved by the holding strap while the auxiliary clip's underside protective backing helps to protect the finish of said electric instrument.

9. A method for utilizing the Musical Instrument Utility Harness comprising:

buckling overlapping ends of utility harness assembly around desired area on the body between the torso and waist;

pulling the utility harness assembly's holding strap, positioned through and anchored to the attached male buckle end of two piece side squeeze buckle for obtaining desired tightness of the utility harness assembly around body;

securing desired portion of instrument to be supported by pulling said holding strap around said instrument and fastening the instrument securing holding strap to a desired velcro area on the holding strap assembly;

temporarily removing said secured instrument from formed loop made by secured holding strap;

rotating fastened utility harness 180 degrees around the body to attach the lateral stability strap assembly;

inserting one end of the lateral stability strap through an unfastened portion of velcro material on the holding strap assembly in an area adjacent to the body's spine in a perpendicular fashion, and looping said lateral stability strap end around the same area as inserted;

adjusting said lateral stability strap's looped position with respect to desired length of lateral stability strap arms;

fastening lateral stability strap sleeve around the adjusted, positioned, and looped lateral stability strap attached to the utility harness assembly;

rotating said utility harness assembly 180 degrees to original position;

reinserting said instrument to secured preformed holding strap loop;

attaching the lateral stability strap arm ends to designated strap pins on said supported instrument;

adjusting the length of the lateral stability strap arms with their respective adjusting buckles to achieve the desired supported instrument's lateral stabilized position on the utility harness assembly, attaching desired accessories to desired velcro areas on the utility harness assembly, and;

attaching holding strap inversion assembly to the instrument holding strap if necessary.

* * * * *